US005701972A

United States Patent [19]

Bloder

[11] Patent Number: 5,701,972

[45] Date of Patent: Dec. 30, 1997

[54] DEVICE FOR ROPING DOWN OR HOISTING PERSONS AND/OR LOADS FROM OR TO GREAT HEIGHTS

[75] Inventor: Hans Bloder, Mariazeller Strasse 52, 8605 Kapfenberg, Austria

[73] Assignee: Hans Bloder, Kapfenberg, Austria

[21] Appl. No.: 381,987

[22] PCT Filed: Aug. 9, 1993

[86] PCT No.: PCT/AT93/00129

§ 371 Date: Mar. 30, 1995

§ 102(e) Date: Mar. 30, 1995

[87] PCT Pub. No.: WO94/03234

PCT Pub. Date: Feb. 17, 1994

[30] Foreign Application Priority Data

Aug. 10, 1992 [AT] Austria ..... 1606/92

[51] Int. Cl.[6] ..... A62B 1/14

[52] U.S. Cl. ..... 182/234; 182/239; 182/241; 188/185

[58] Field of Search ..... 182/42, 234, 239, 182/241; 254/310, 391; 188/180, 185, 189

[56] References Cited

U.S. PATENT DOCUMENTS

| | | | |
|---|---|---|---|
| 3,946,989 | 3/1976 | Tsuda | 188/185 |
| 4,000,881 | 1/1977 | Matsumoto | 182/241 |
| 4,487,292 | 12/1984 | Smith et al. | 182/239 |
| 4,655,327 | 4/1987 | Tomioka et al. | 188/180 |
| 5,351,906 | 10/1994 | Feathers | 182/239 |
| 5,447,280 | 9/1995 | Feathers | 182/239 |

FOREIGN PATENT DOCUMENTS

| | | |
|---|---|---|
| A 2623788 | 6/1989 | France . |
| C 295622 | 12/1916 | Germany . |
| A 559551 | 3/1975 | Switzerland . |

*Primary Examiner*—Michael Safavi
*Attorney, Agent, or Firm*—Henry M. Feiereisen

[57] ABSTRACT

A device for lowering or raising people and/or loads over heights, in which the rope pulley is rotatably fitted on a base plate via a brake disc. A brake pad is allocated to the brake disc on one side of the base plate and on the other on a pressure plate secured against rotation. Pressure can be applied to the pressure plate by a tension bolt passing through the brake disc bearing and the tension bolt is coupled to the suspension of the device via a power deflection device via which the weight of the person and/or load to be lowered or raised can be converted into a tensile force on the bolt. A concentrically arranged toothed wheel is connected to the brake disc which engages with a gear system also fitted in the base plate via which an additional centrifugal braking device can be actuated. At this point, the suspension of the device takes the form of a pull rod guided to be movable on the base plate an end of which can pivot on an arm of a bell-crank lever, with the other end pivotally connected to the tension bolt.

19 Claims, 10 Drawing Sheets

DEVICE FOR ROPING DOWN OR HOISTING PERSONS AND/OR LOADS FROM OR TO GREAT HEIGHTS

The invention refers to a device for roping down or hoisting persons and/or loads from or into great heights, including a rope pulley rotatably supported by a base plate via a brake disk, with a brake lining being associated to the brake disk on one side on the base plate and on the other side at a pressure plate which is secured against rotation with a respective brake lining wherein pressure is applied onto the pressure plate by a tension bolt which traverses the brake disk bearing and is connected with the suspension of the device via a force deflection unit via which the weight of the person and/or load being roped down or hoisted is convertible into a tensile force on the bolt, and wherein the brake disk is connected to a concentric gear rim in mesh with a gearing which is also supported in the base plate and via which at least an additional centrifugal brake unit can be driven.

Such devices are especially provided for rescuing people and/or loads from high floors during fire since rescue hoses, jumping sheets and air cushions for such high floors are not easily usable and have the known risks. Further, such devices are also usable for all different kinds of purposes, for example during mountain rescue operations during which injured persons are to be roped down or up from greater heights, e.g. from steep rocks.

For this purpose, a device of the above stated kind is provided in which the force deflection unit is formed by a lever acting upon a screw nut and engaged by a tension element, with the lever applying via the nut in dependence on the load a more or less great tensile force upon the tension bolt so that a greater braking force can be attained via the brake disk in connection with persons or loads of higher weight whereupon with loads of smaller weight an accordingly smaller braking force is applied so that the rope down process operates essentially at a same speed. When being utilized for bi-directional rotation, the known embodiment has the drawback that the brake disk and the cooperating brake linings transmit a torsional moment onto the base plate so that depending on the direction of rotation of the brake disk, in one instance a relief of the tensile force upon the tension element which adjusts the nut of the tension bolt is effected and in another instance an increased force is applied so that in case a same load is to be roped down a slightly faster lowering in one rotational direction of the brake disk is encountered than in the other rotational direction of the brake disk in which the rope down operation runs slightly slower.

Advantageously, the tension bolt bears upon the pressure plate via a spherical calotte shaped surface which engages a diametrically opposed recess in the pressure plate. In this manner, the pressure is always evenly applied over the entire surface of the pressure plate regardless of the pivot position of the tension bolt. Further, a conventional stop unit for blocking the rope travel in one direction may be provided on the centrifugal brake unit in addition to the brake unit acted upon by the tension belt, with this stop unit enabling via an interposed friction clutch that at least one stop bolt bears upon the brake shoes of the centrifugal brake unit to effect an increase of the brake force. This unit prevents the stop unit from executing a strong jerk for blocking the rope travel in one direction when being started, whereby the interposed friction clutch and the contact of the stop bolt upon the brake shoes of the centrifugal unit effects that the centrifugal brake operates as compulsory brake which brakes the rope pulley together with the friction clutch via the interposed gearing in such a manner that a jerky standstill of the lowering rope strand is attained. The combination of friction clutch and centrifugal brake splits the friction force between the stop unit and the rope pulley in such a manner that an overstress of the brake unit and the friction clutch is avoided even when repeatedly stopping the rope down operation by the stop unit. Moreover, the sliding braking of the rope avoids overextensions of the rope during a jerky stoppage. Further, for each of the two rotational directions of the brake disk and the connected gear rim, a separate centrifugal brake unit may be provided which operates in dependence on the rotational direction of the brake disk. This has the advantage that upon alternating rotational direction of the brake disk only one of both centrifugal brake units is activated during operation, with the other centrifugal brake unit being able to cool down. This is important because the centrifugal brake may still apply a very high brake force via the brake disk when the main brake unit experiences a possible fading, thereby ensuring a safe lowering even after repeated rope down operations so that the device is suitable also for permanent uses.

For adjusting the brake force of the brake disk acted upon by the tension bolt, the tie rod can be adjustable in longitudinal direction, preferably by means of a screw, for preadjustment of the tensile force of the tension bolt. This enables a respective presetting of the rope-down velocity defined by the brake disk acted upon by the tension bolt. Thereby, the screw can be arranged on the base plate or on a component securely fixed therewith and act upon a lever which has a pivot axis being also arranged on the base plate or a component securely fixed thereto, with the lever engaging a recess of the tie rod and bearing upon the transverse flanks of the recesses. In this manner, a very precise adjustment of the tensile force of the tension bolt is possible. Further, an additional adjusting unit may be secured to the bell-crank lever for changing the angle position of the bell-crank lever and thus for adjustment of the tension bolt. The modification of the position of the bell-crank lever and the ensuing change of the geometry of the force deflection unit results in a preadjustment of the introduced tensile force and in a neutralization of the brake force during hoisting.

In accordance with a further feature of the subject matter of the invention, a hoisting winch unit may be attached on the base plate or a component securely fixed thereto and engageable with the gear rim connected to the brake disk. Thus, the device according to the invention may be usable for hoisting persons and/or loads, with the hoisting winch unit disengaging at idle operation from the gear rim connected to the brake disk. In order to ensure during hoisting of persons and loads that no unintentional lowering is encountered, the hoisting winch unit may be provided with a gear mechanism with return stop in mesh with the gear rim via a connection gear.

In accordance with a particular simple embodiment, the gear mechanism with return stop may be designed in form of a self-locking worm gearing.

The rope pulley connected to the gear rim via the brake disk may include a rope bed lined with an anti-slip material, with, preferably several, prestressed units being provided for pressing the rope into the rope bed to thereby prevent a slippage of the rope at the rope pulley even when heavy persons or greater loads are concerned. The unit can be prestressed by arranging a rope track race upon an eccentrically adjustable bearing by which the pressing force is fixedly adjustable. In case an elastic prestress is desired, the prestress of the unit can be effected by supporting a rope roller upon a pivot lever which is loaded by a spring in direction of a pivoting toward the rope pulley. Thus, fluctuations of the diameter of the rope will not have any adverse effect upon the pressing force in the rope pulley.

In order to prevent a crossing or twisting of both downwardly hanging rope strands, a roller guide may be provided on the base plate in the area of the lower runouts of both rope strands for distancing both rope strands. In order to prevent the roller guide from receiving weight forces, the roller guide is adjustably arranged freely upon the base plate transversely to the rope runout direction. The adjustment of the roller guide may be effected by a carriage which rotatably supports the rope rollers of the roller guide and is slidably supported by guides provided on the base plate. In this manner, always the one rope which carries the person or the load is assured to pass downwards while the other rope strand is kept away by the roller guide from the loaded rope strand. Then, when the other rope strand is loaded, the carriage can adjust such that the now unloaded rope strand is distanced from the loaded rope strand.

In accordance with a particular simple embodiment, the guides may be designed as rods upon which the roller guide is movable via retainer rollers. Thus, the guides can easily be replaced if, for some reason, they have too much play.

Finally, guide elements may be arranged on the base plate or on a component connected therewith at the outer plate parallel to the tie rod, by which the device is slidably guided in a frame or the like. This is especially advantageous when the rope strands are routed about external deflection rollers and the rope-down device is positioned horizontally to allow a rope down for example via window ledges, wall crests or balcony enclosures, with the device according to the invention being anchored by the frame or by another building-fixed part.

The drawing illustrates an exemplified embodiment of the subject matter of the invention.

Figure 1:
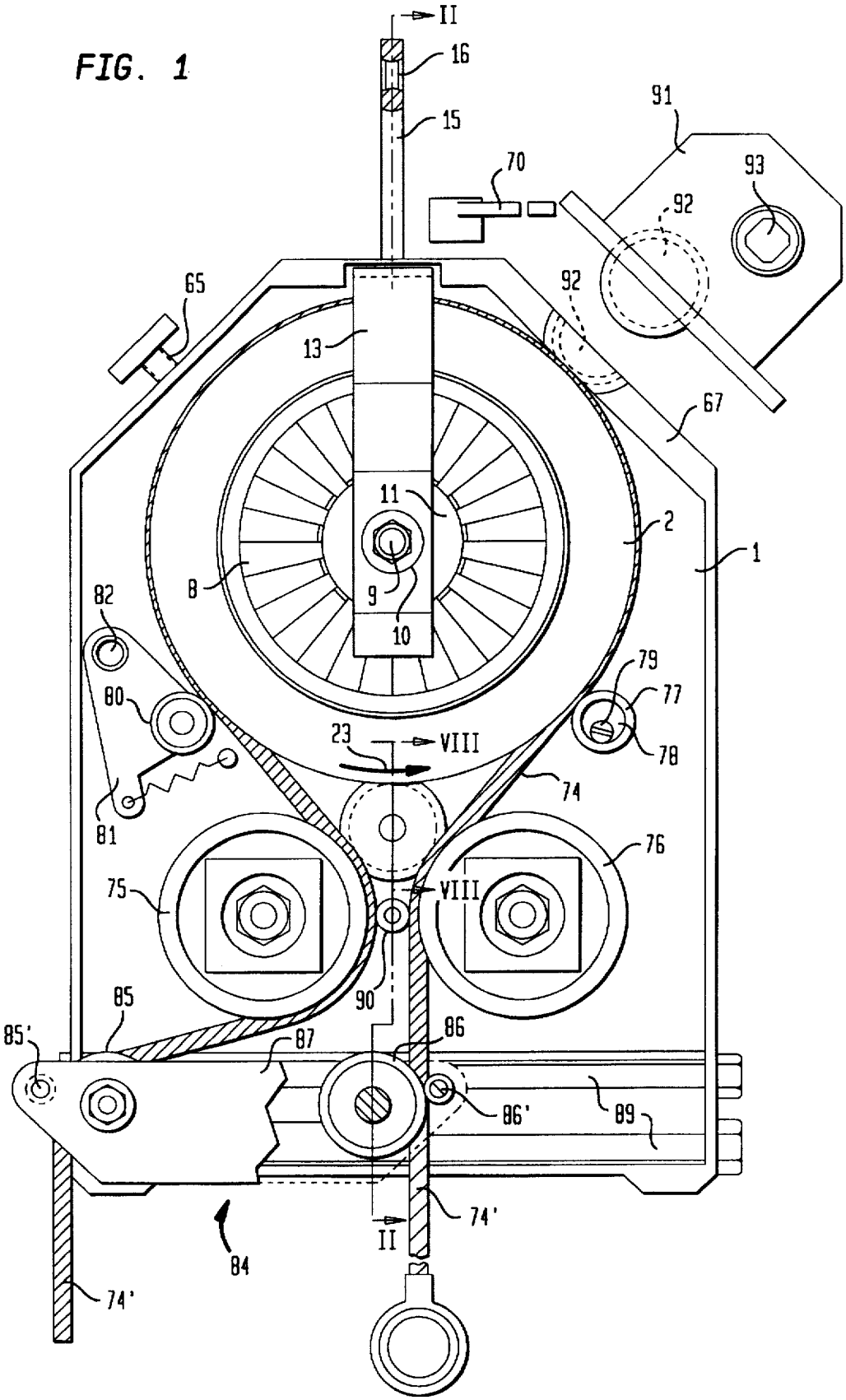
FIG. 1 shows the front side of the device, with the housing being removed for illustration of the rope guide within the device.

Reference numeral I designates a base plate which rotatably supports a rope pulley 2 with an interposed brake disk 3. The base plate is connected with a journal 4 which is provided with an inner concentrically traversing bore 5. Arranged at the brake disk facing the base plate 1 is a brake lining 6 and at the side facing away from the base plate a brake lining 7 upon which a pressure plate 8 is pressable, with pressure being applied upon the pressure plate 8 by a tension bolt 9 which includes a head portion 10 formed interiorly with a spherical calotte shaped surface that is received in a complementary recess plate 11 through the plate 8, brake disk 3 and the base plate 1 with the tension bolt 9 traversing the pressure plate 8, brake disk 3 and base plate 1. This plate 11 bears upon a clamp 12 which secures the pressure plate 8 against rotation and is connected via an angle 13 with the base plate 1.

The tension bolt 9 is connected via a force deflection unit 14 with a tie rod 15, the free end of which carries a suspension unit 16. The force deflection unit 14 is formed by a bell-crank lever 17 which is pivotably connected on one end to the tension bolt 9 via a rotational axis 18 and with its other end on the tie rod 15 via a rotational axis 19. The bell-crank lever is pivotably supported at 20 on the base plate 1 via bearing support 21.

Figure 4:
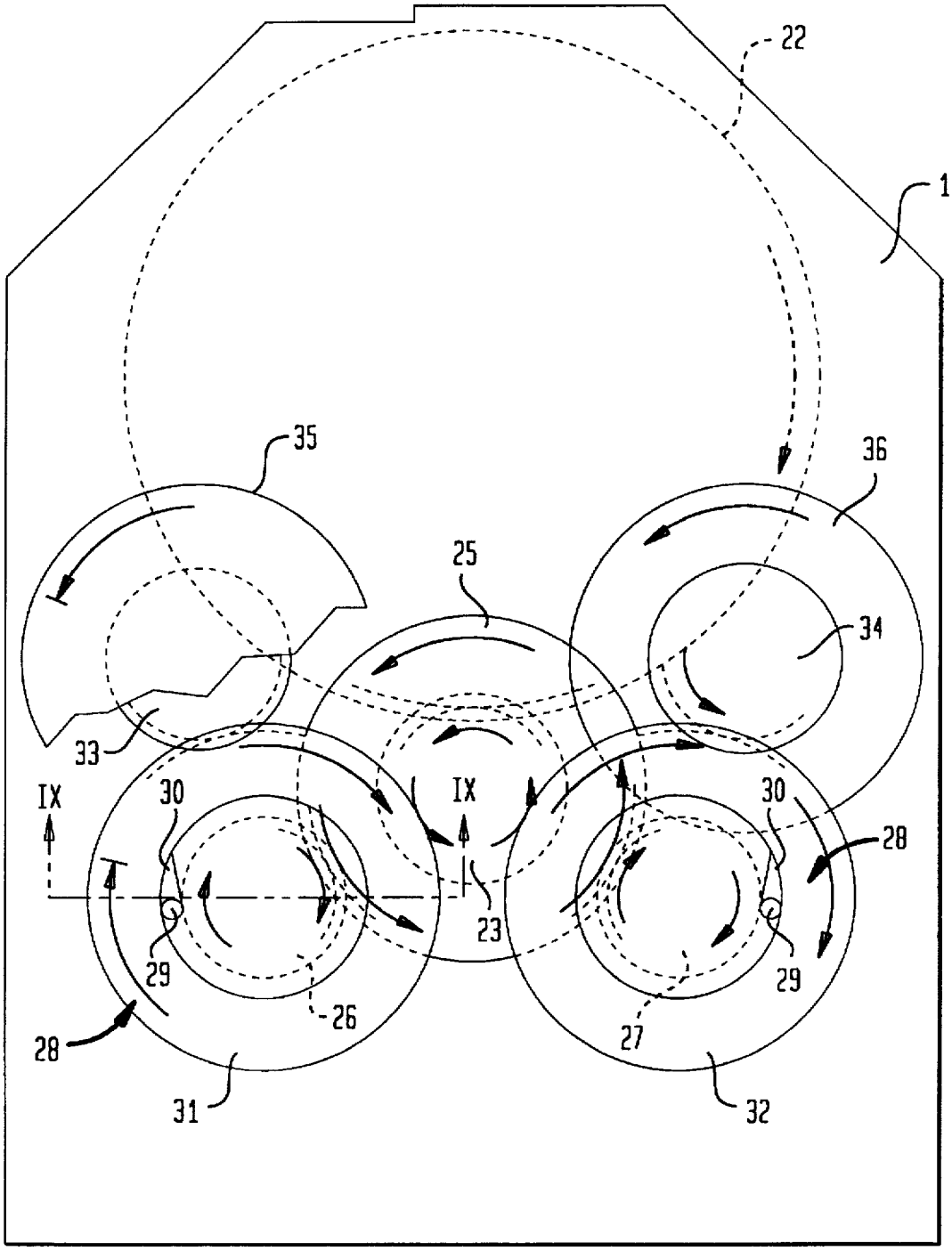
FIG. 4 depicts schematically the gearing between the brake disk and the centrifugal brakes.

The brake disk 3 includes a gear rim 22 which is in mesh with a pinion gear 23 which is also rotatably supported on the base plate 1. This pinion gear is secured to a shaft 24 for rotation therewith, with the shaft 24 traversing the base plate 1 and carrying on the other side a further gear 25. The gear 25 is in mesh with two gears 26, 27 which are also supported by the base plate 1. These gears carry a free-wheel unit 28 which is formed in the present case by rollers 29 rolling along an inclined plane 30. Depending on the rotational direction of the gears 26, 27, the roller 29 is movable along the inclined plane either into its retracting position relative to the center or ascends through rolling off on the inclined plane 30 to effect a clamping between the gears 31, 32 arranged coaxially with the gears 26, 27. These gears 31, 32 mesh in turn with pinion gears 33, 34 which are coaxially securely connected with support plates 35, 36 for a centrifugal brake unit. As shown in FIG. 4, the gear 22 and the meshing pinion gear 23 are arranged on one side of the base plate and the other gears of the gearing are arranged on the opposite side of the base plate.

The centrifugal brake units arranged on the support plates 35, 36 are designated with 37 and 38.

Figure 5:
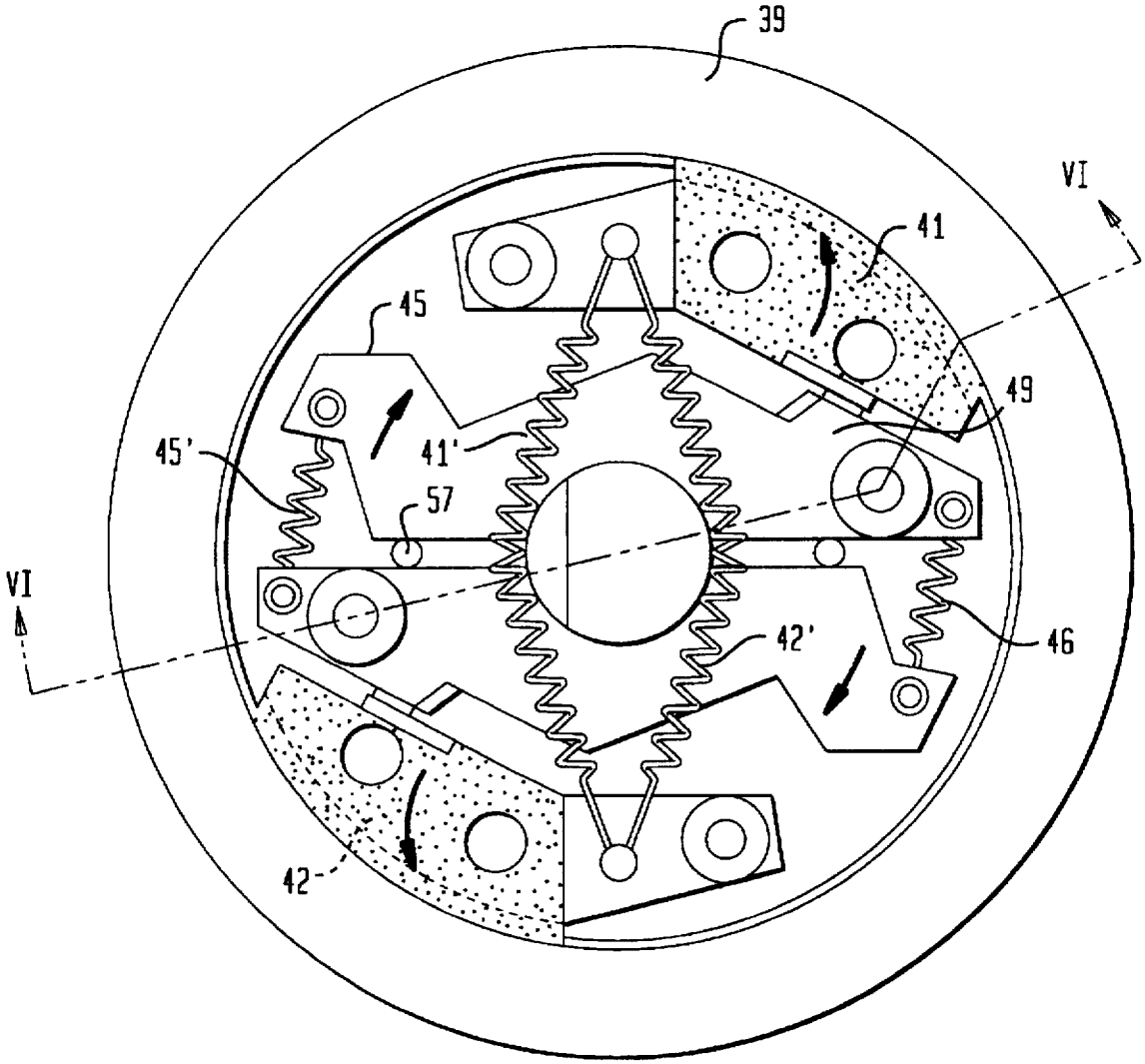
FIG. 5 is a detailed illustration of the centrifugal brake, on an enlarged scale, with only one of both shoes and its actuating lever being shown.
Figure 6:
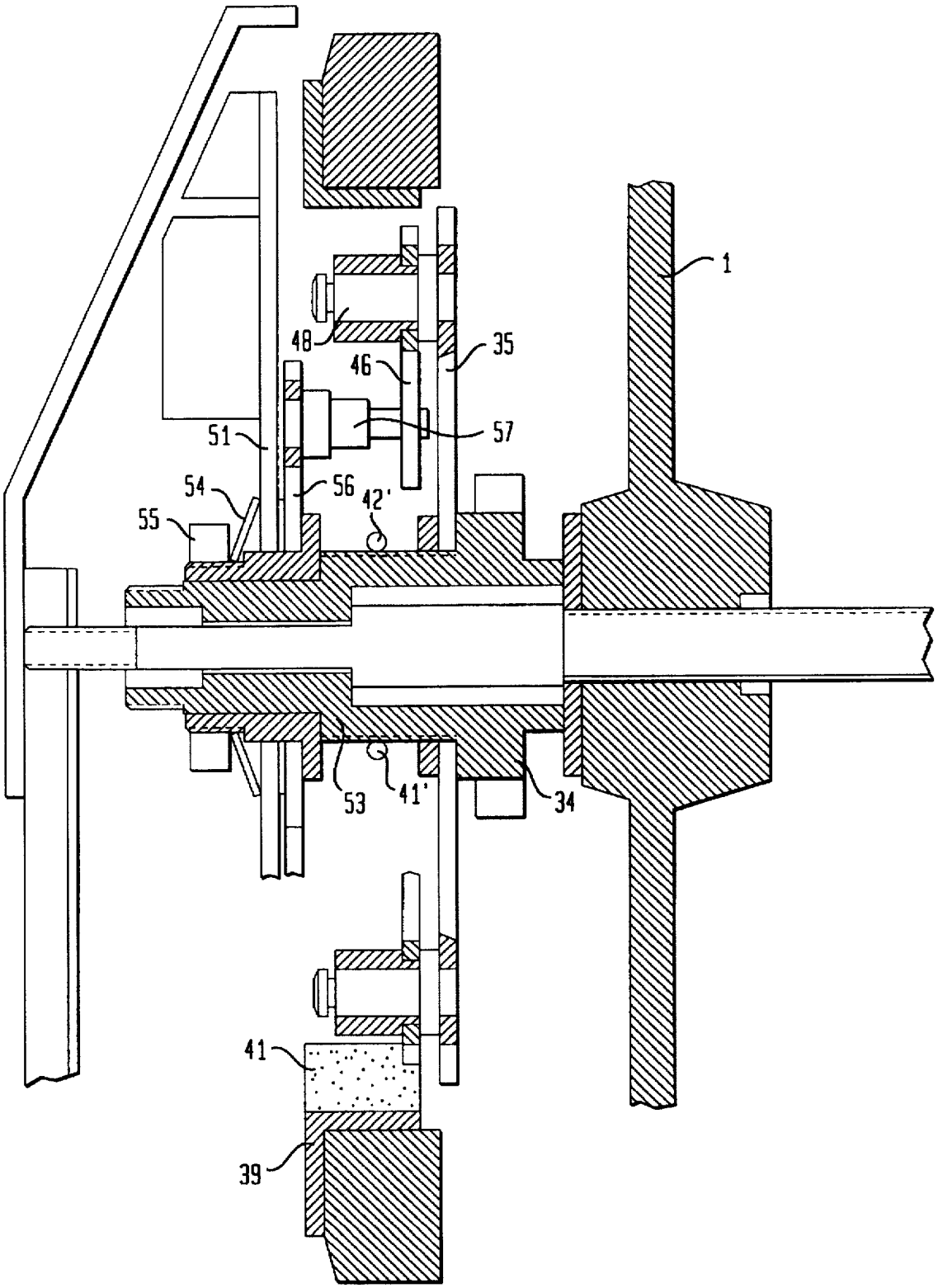
FIG. 6 is a section according to line VI—VI of FIG. 5.

The centrifugal brake unit includes, as partially shown on an enlarged scale in FIG. 5, a brake ring 39, 40, respectively, securely mounted to the base plate 1 and having a cylindrical inner surface serving as brake surface for brake shoes 41, 42. The brake shoes are freely pivotably articulated to the base plate 35 via pivot axes 43, 44, with pivot levers 45, 46 being additionally provided which are also articulated to the support plate 35 via pivot axes 47, 48. Both brake shoes 41, 42 are loaded by springs 41', 42' in direction toward a lifting of the brake shoes from the brake ring 39. The pivot levers 45, 46 include actuating cams 49, 50 which exert at respective speed of the support plate 35 in addition to the centrifugal force of the brake shoes a pressure upon the brake shoes in order to effect the braking action. Engaging the pivot levers 45, 46 are tension springs 45', 46' which have a tendency in the initial position to draw away the pivot levers from the brake shoes 41, 42. The support plates 35 include a central, preferably cylindrical body which carries on its top a stop lever 51, 52. This stop lever is connected with the central projection via a friction clutch which is formed by threadably engaging the stop lever 51 to the central projection 53 through a nut 55 via a spring disk 54. Thus, the metal-on-metal formation creates a friction unit which serves as pure friction clutch. Placed upon the projection at this friction clutch between stop lever 51 and the central projection 53 is a further lever which is designated in FIG. 6 at 56. Projecting from this lever 56 into the movement path of the pivot levers 45 and 46 are stop bolts 57 so that during braking of the stop lever 51 the stop bolts 57 swing the levers 45, 46 in such a manner that the cam elements 49, 50 press upon the brake shoes 41, 42 and increase the braking action of the centrifugal brakes. At the same time, a slippage is effected between the stop lever 51 and the lever 56 so that during braking a jerk-free braking into standstill is accomplished by letting the stop lever 51 to run upon a swingable stop 58.

This stop 58 is provided on a pivot lever 59 and is alternately swingable into the movement path of the stop lever 51, 52 whereby a central position in which both stop levers 51, 52 are freely movable cannot exist. The pivot lever 59 is pivotable from outside via hand grips 59'.

The tie rod 15 includes a recess 60 which has horizontal flanks 61, 62, with a pivot lever 63 engaging therebetween and being supported by the base plate 1 via an axle 64. Acting upon the recess-distant end of the lever is a screw 65 which is threadably engaged into a threaded piece 66 of the frame 67 that is securely mounted to the base plate 1.

Further provided on the force deflection unit 14 is an adjusting screw 68 which is rotatably supported via a distancing nut 69 in the frame 67 and secured against displacement. This screw 68 is rotatable by means of a ratchet 70, with the threaded piece 71 of the screw being threadably engageable in or disengageable from a threaded part 72 of the force deflection unit 14. A clockwise rotation of the screw 68 effects a pressure increase and a counterclockwise rotation effects a pressure reduction or pressure neutralization.

The rope pulley 2 includes a rope bed 73 of anti-slip material in which the rope 74 can be pressed in. The rope is routed via deflection pulleys 75. 76 in order to attain a high envelope angle of about 270°. The deflection pulleys 75, 76 are rotatably supported in a conventional manner on the base plate 1.

In order to ensure the pressing of the rope 74 into the rope bed 73, a rope roller 77 may be provided which is rotatably supported by an eccentric 78 secured to the base plate 1 via a screw fastener 79. The pressing of the rope may also be effected by a pivotable unit by which a rope roller 80 on a pivot lever 81 is supported via an axle 82 by the base plate 1, with the pivot lever 81 being loaded by a spring 83 in direction of movement towards the rope bed.

The rope strands exiting beneath the deflection pulleys 75, 76 are designated by 74' and 74". Both rope strands 74', 74" are spaced from each other via a roller guide 84 by rope rollers 85, 86. Both these rope rollers am secured to a carriage 87 which is freely movable via retainer rollers 88 along guide rods 89 transversely to the rope runout direction. Provided between the deflection pulleys 75, 76 is a rope guide 90 which prevents the rope from popping out from the deflection pulleys even at a looping or other jerky movements in longitudinal direction of the rope. The rope strands 74' and 74" are secured in the rope rollers 85, 86 through retainer rollers 85' and 86' to prevent them from popping out.

Figure 2:
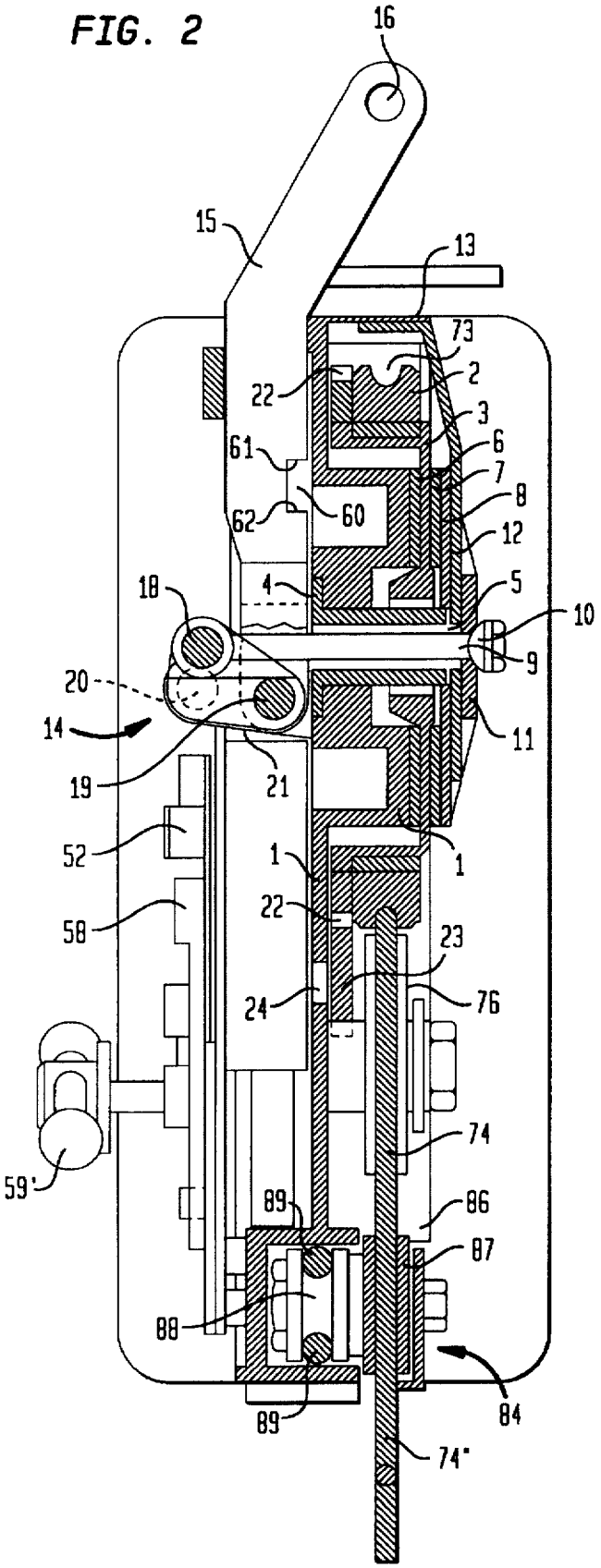
FIG. 2 is a section according to line II—II of FIG. 1.
Figure 7:
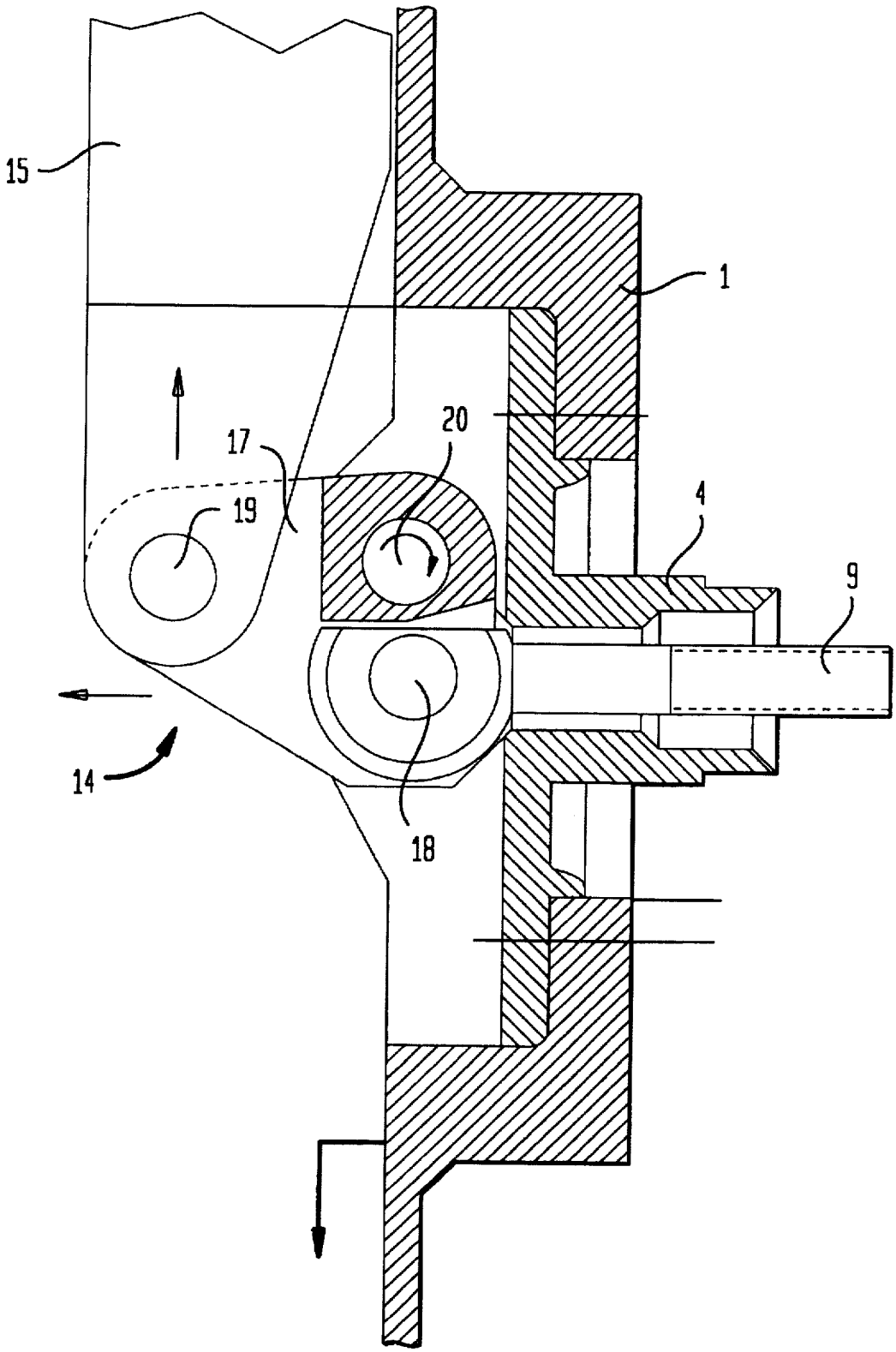
FIG. 7 shows a vertical section of a detailed illustration of another embodiment of the force deflection unit between tie rod and tension bolt.
Figure 8:
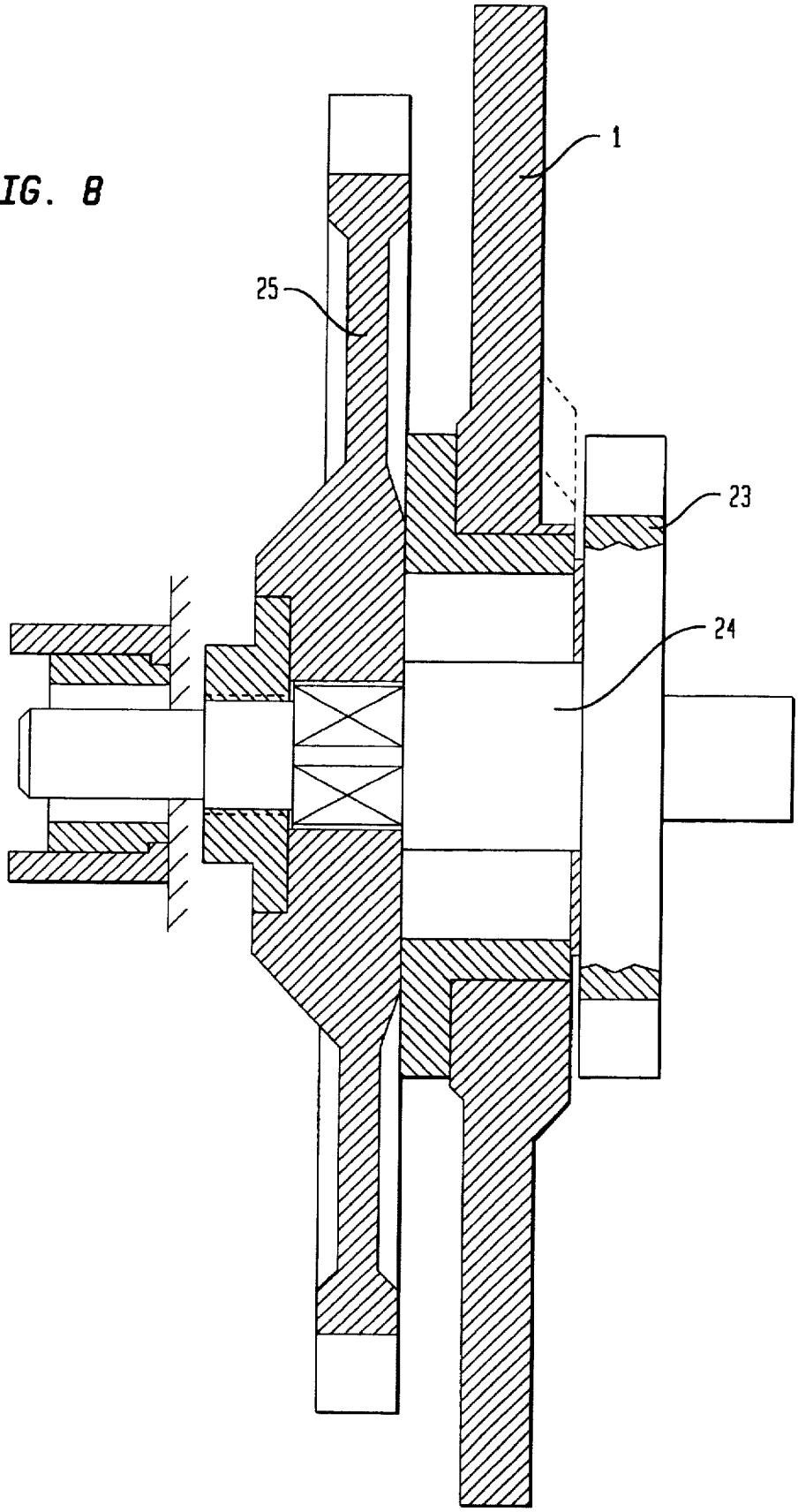
FIG. 8 is a section according to line VIII—VIII in FIG. 1.
Figure 9:
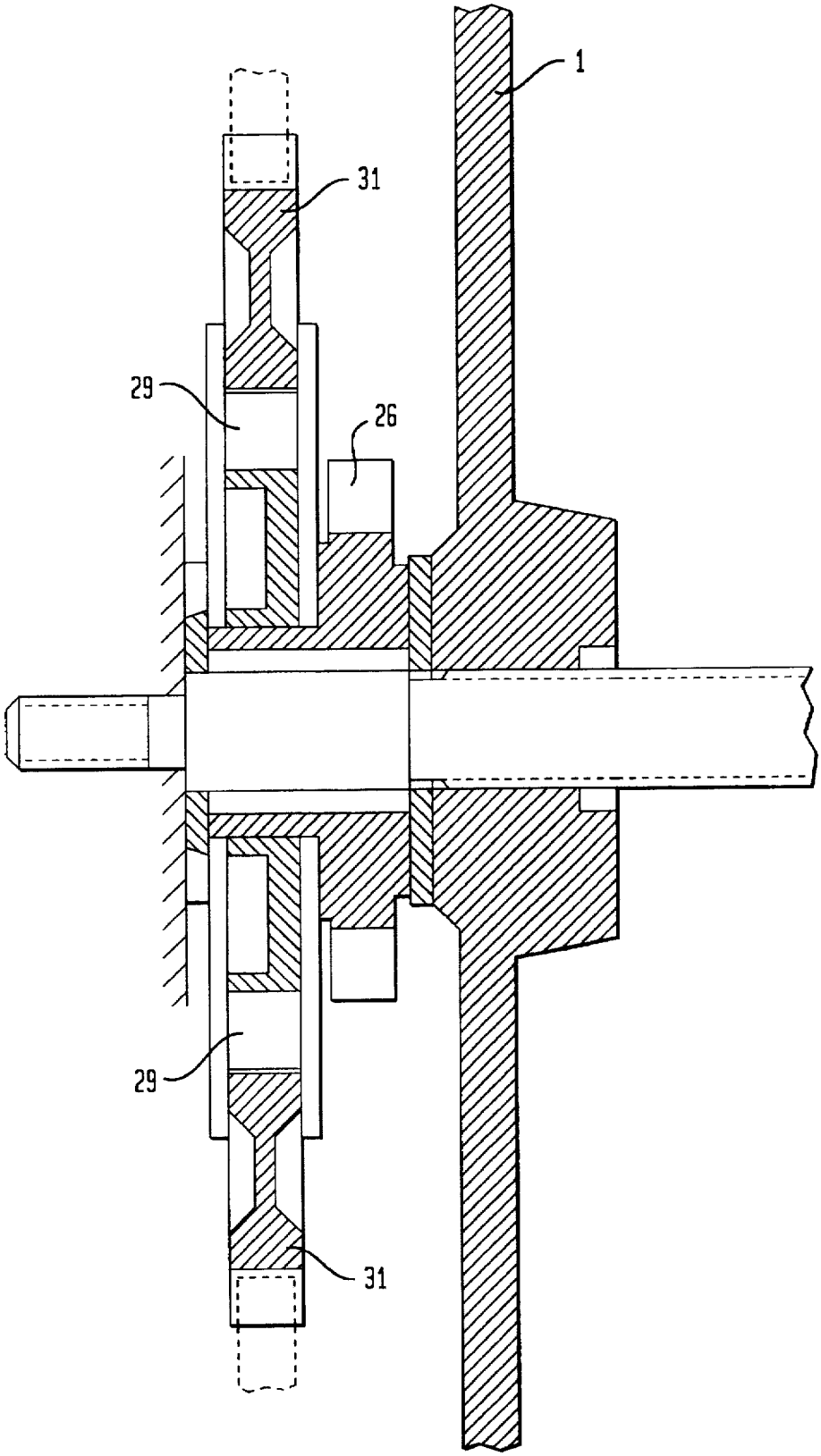
FIG. 9 is a section according to line IX—IX of FIG. 4.

FIG. 7 shows a slightly modified design of the force deflection unit 14 in which the bell-crank lever 17 is supported by the base plate 1 at 20 above the axle 18 for connection between tie rod 9 and bell-crank lever 17, with the connection between tie rod and boll crank lever again being designated with 19. The operation of this design is identical to the one according to FIG. 2.

FIG. 1 indicates in the right upper area a hoisting winch unit 91 which includes a connection gear 92 engageable in the gear rim 22 of the brake disk 3. This connection gear 92 is driven by a crank unit 93, namely in case of the embodiment according to FIG. 1 via a gearing not shown in detail. On the other hand, the connection gear 92 may also be driven in a manner according to the embodiment of FIGS. 10 and 11 via a worm gearing 94 in which the worm 95 can be rotated via a crank 96 that is placed upon the worm shafts 97. In mesh with the worm 95 is a worm wheel 98 which drives the connection gear 92 via an interposed gear 99. The crank unit 93 is secured to the frame 67 of the base plate 1 and disengageable therefrom. This is necessary because the design of the hoisting winch unit 91 as self-locking worm gearing enables a rope down at engaged gearing only by turning the crank 96 because otherwise the self locking of the worm gearing would not allow a free rotation of the rope pulley 2.

Figure 3:
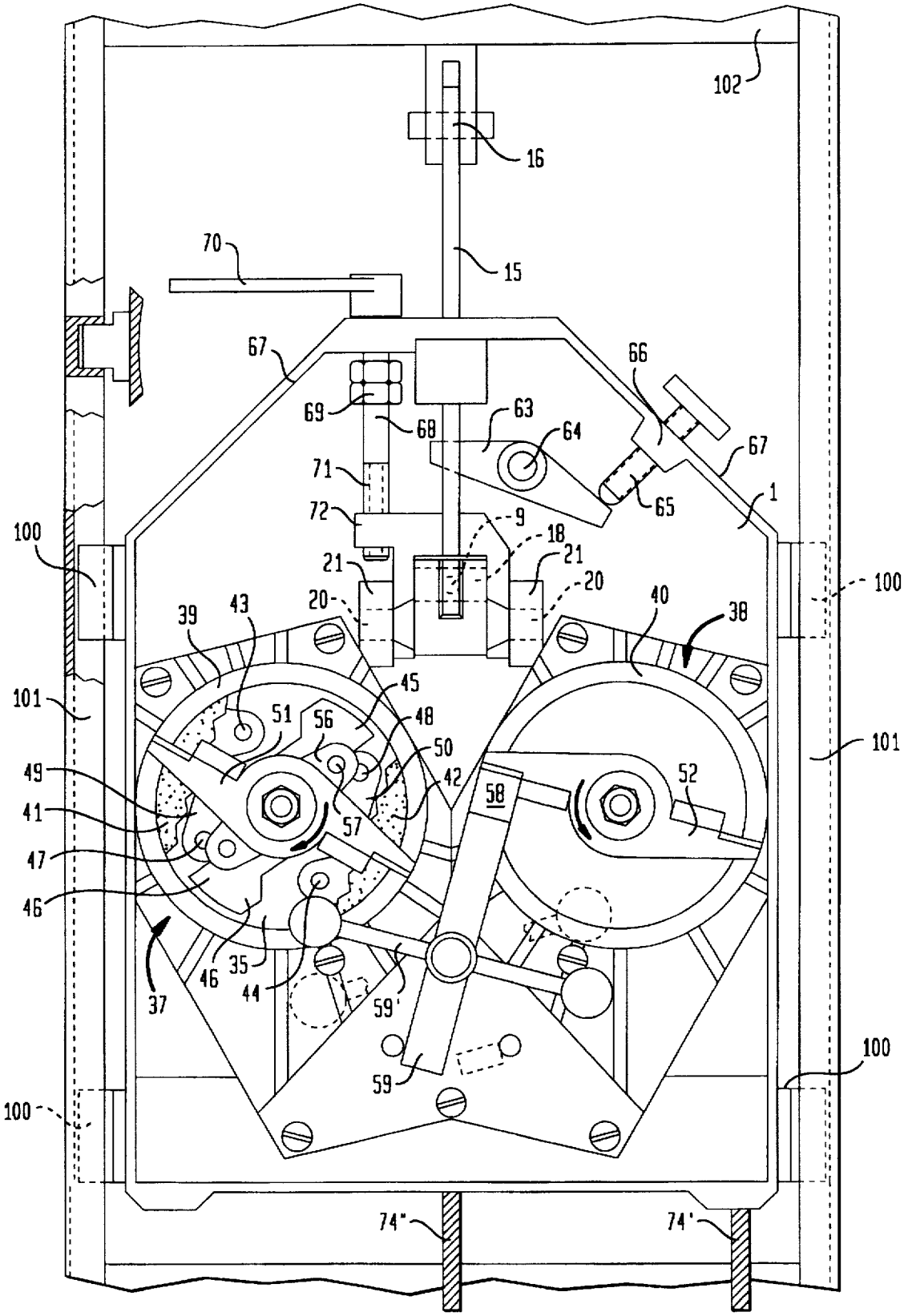
FIG. 3 shows the rear side of the device, with the lid being removed and the device being slidably guided in a frame. In the one centrifugal brake, the single parts of the centrifugal brake are not depicted for better illustration of the force transmission.

As shown in FIG. 3, the frame 76 of the device includes guide lugs 100 which are guided for displacement in a support frame 101 in direction of the rope travel. The suspension 16 may engage a cross bar 102 of the support frame 101, or the suspension 16 may be directly secured to a fixed component.

In case a person should be roped down from great height by the device according to the invention, the stop 58 is positioned at the respectively associated stop level 51 or 52 depending on which of both rope strands 74', 74" should be in operation. In the present case, the stop level 51 would be blocked in the initial position according to FIG. 1 because of the mirror image view from behind by means of the stop 58. Thereafter, the person to be roped down steps into the carrier device, e.g. trousers-like harness of high strength plastic material or the like, hooked to the end of the rope strand 74", with a downward movement of the rope strand being executed at best until the stop lever 51 runs dead on the stop 58. If the person is readied for being roped down, the pivot lever 59 is swung by means of the hand lever 59' until the stop lever 51 disengages from the stop 58 which then swings into the movement path of the stop lever 52. As soon as the stop lever 51 comes free, the rope down operation begins, whereby the weight of the person being lowered effects through the force deflection unit that the hanging force upon the tie rod is introduced as braking force via the tension bolt 9 upon the main brake via the pressure plate 8 so that the brake disk 3 is clamped between both brake linings 6, 7 by the own weight of the person being roped down. Via the gear rim 22, the pinion gear 23, the shaft 24, the gear 25, the gears 26, 27 and 31 to 34, the one support plate 35 or 36, respectively, in which the free-wheel unit occupies the engagement position is caused to rotate. If the rope down operation increases the speed of the rope travel, a braking action is obtained in the centrifugal brake because of the outwardly pushed brake shoes and the additional pivot levers 45, 46, namely by the pressing action of the brake shoes upon the brake rings 39 to thereby create a braking effect, as in conventional drum brakes. The centrifugal brakes act only at respectively higher speed and thus serve to provide the one braking force which goes beyond the braking capability of the main brake unit, brake disk 3 and brake linings 6, 7 as well as pressure plate 8. The moment of adding the centrifugal brakes is determined by the tensile force of the springs 41', 42' and 44', 45', respectively, since this spring force must be overcome by the centrifugal force.

If for any reason the rope-down operation should be stopped, the pivot lever 59 is swung via the hand grip 59' in FIG. 3 in counterclockwise direction so that the stop 58 is swung into the movement path of the stop lever 51. Thus, the stop lever 51 runs onto the stop 58 so that the friction unit 53, 54, 55 causes a slippage of the stop lever 51 relative to the central projection 53 of the support plate 35. This friction clutch entrains the lever 56 and moves the stop bolt 57 into contact with the pivot levers 45, 46 which now act upon the brake pads 41, 42 via their cams 49, 50 to effect a braking. Thus, an additive action of friction clutch and centrifugal brake is created so that a soft braking is attained, and the braking force between the friction clutch and the centrifugal brake is split. The rope-down operation is continued by moving the stop 58 out of the movement path of the stop lever 51 so that the rope-down operation can again resume. When subjecting the rope strand 74" to a load, the roller guide 84 is moved into the position shown in FIG. 1 so that the unloaded rope strand 74' is distanced from the loaded rope strand 74" by the rope roller 85.

After termination of the rope-down operation, the clevis-type eyelet of the rope strand 74 is ready for use, with the stop brake being positioned as shown in FIG. 3. If now the rope strand 74' is loaded, the roller guide slides over the retainer rollers 88 at the guides 89 to such a degree to the right as shown in FIG. 1 until the rope strand 74 can roll off downwards in a straight line from the deflection roller 75 and the rope strand 74" is held at a distance from the loaded rope strand 74'. The rope-down operation is effected in a same manner as described above, with the difference residing only in the operation of the centrifugal unit 38 instead of the centrifugal brake unit 37. The centrifugal unit 37 can cool down during the rope-down operation via the rope strand 74' to substantially eliminate a brake fading.

Figure 10:
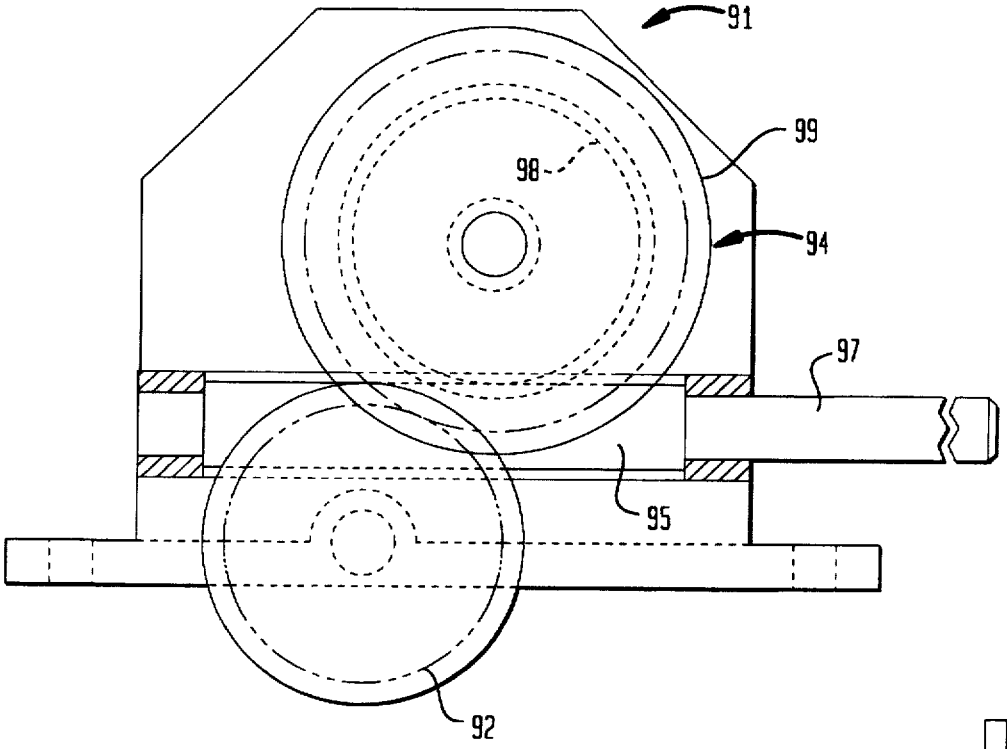
FIG. 10 depicts a schematic end view of the attachable hoisting winch unit.
Figure 11:
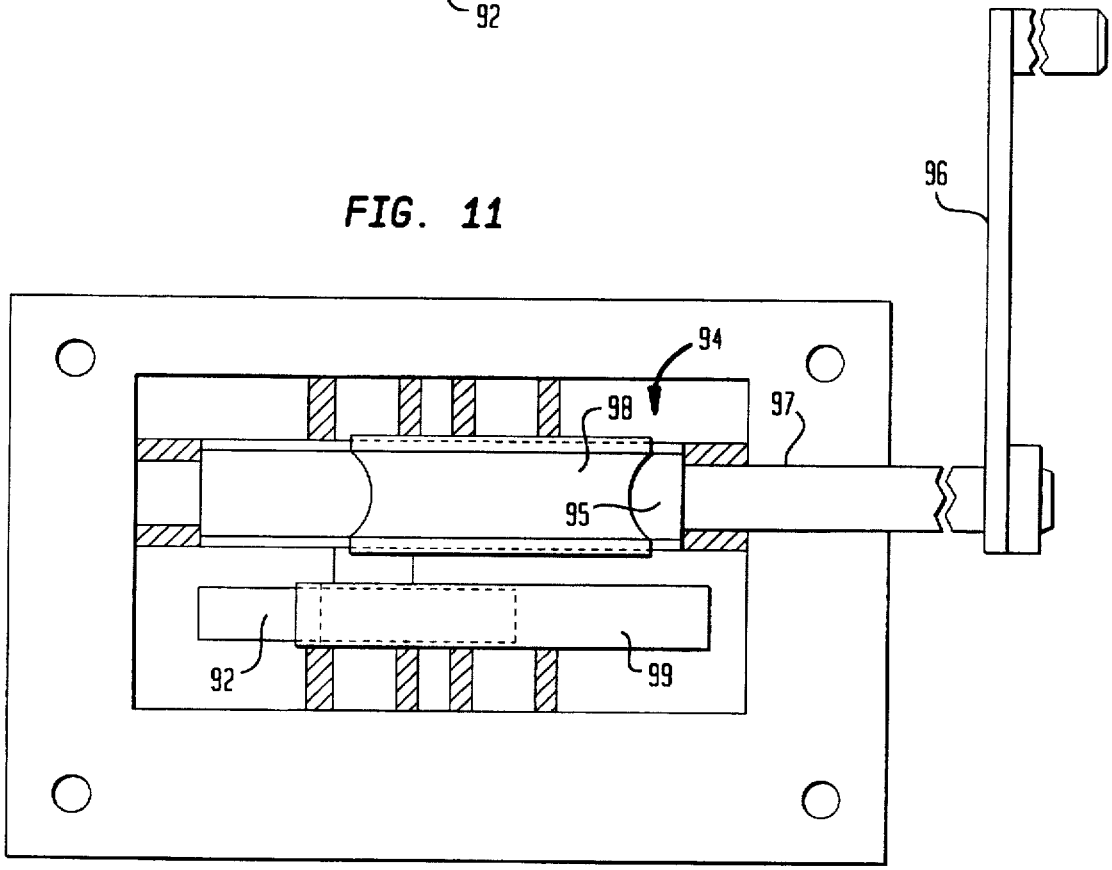
FIG. 11 is a partial sectional plan view of the hoisting winch unit, with removed lid.

In the event, the device according to the invention is used for hoisting a person or a load, the hoisting winch unit 91 is employed or operated, namely by turning the crank unit 93 according to FIG. 1 or the crank 96 according to FIGS. 10, 11 to rotate the connection gear 92 such that the respective rope strand is pulled up via the gear rim 22. For safety reasons, the stop 58 is switched such as to project into the respective movement path of the stop lever 51 or 52, respectively, which in case of a release of the crank unit if slipping for any reason effects a braking of the person or load being hoisted via the friction unit and the centrifugal brake. Thus, the safety is doubled by the self locking of the gearing, on the one hand, and by the respectively added friction unit and centrifugal brake unit, on the other hand.

I claim:

1. Device for roping down or hoisting persons and/or loads from or into great heights, including a suspension, a rope pulley rotatably supported by a base plate via a brake disk, with a brake lining being associated with the brake disk on one side along the base plate and on the other side along a pressure plate which is secured against rotation with a respective brake lining wherein pressure is applied onto the pressure plate by a tension bolt which traverses the brake disk and is connected with the suspension via a force deflection unit via which the weight of the person and/or load being roped down or hoisted is convertible into a tensile force on the bolt, and wherein the brake disk is connected to a concentric gear rim in mesh with a gearing which is supported in the base plate, and further including at least a centrifugal brake unit which is driven by the gearing, wherein the suspension (16) is formed by a tie rod (15) preferably guided for displacement on the base plate (1) and having one end (19) pivotably supported on one arm of a bell-crank lever (17) which is pivotably supported on the base plate (1) and has an other arm pivotably connected with the tension bolt (9).

2. Device according to claim 1, wherein the tension bolt (9) has a head portion formed interiorly with a spherical calotte shaped surface for engagement in a complementary recess of a plate (11) positioned between the head portion (10) and the pressure plate (8) to act upon the pressure plate (8).

3. Device according to claim 1, wherein a conventional stop unit (51, 52) for blocking the rope travel in one direction is provided on the centrifugal brake unit (37, 38) in addition to the brake unit (6, 3, 7) acted upon by the tension bolt (9), and that this stop unit enables an engagement of at least one stop bolt (57) via an interposed friction clutch (54, 55) upon the brake shoes (41) of the centrifugal brake unit (37, 38) to effect an increase of the braking action.

4. Device according to claim 3, wherein the brake disk (3) is rotatable in two rotational direction, wherein for each of the two rotational directions of the brake disk (3) and the gear rim (22) connected therewith a separate centrifugal brake unit (37, 38, respectively) is provided which are in operation in dependence of the rotational direction of the brake disk (3).

5. Device according to claim 1, wherein the tie rod (15) is adjustable in a longitudinal direction to effect a presetting of the tensile force of the tension bolt (9).

6. Device according to claim 5, and further comprising a screw (65) for adjusting the tie rod (15) in a longitudinal direction.

7. Device according to claim 1, wherein an additional adjustment unit (68–71) for modifying the angular position of the bell-crank lever (17) and thus the adjustment of the tension bolt (9) is connected to the bell-crank lever (17).

8. Device according to claim 1, wherein a hoisting winch unit (91) is mounted to the base plate (1) or a component (67) securely connected therewith and is engageable with the gear rim (22) connected with the brake disk (3).

9. Device according to claim 8, wherein the hoisting winch unit (91) includes a gearing with return stop in mesh with the gear rim (22) via a connection gear (92).

10. Device according to claim 9, wherein the gearing with return stop is formed as self-locking worm gearing (95, 98).

11. Device according to claim 1, wherein the rope pulley (2) connected with the gear rim (22) via the brake disk (3) includes a rope bed (73) lined with an anti-slip material, with prestressed units (77–79, and 80–83, respectively) being provided for pressing the rope (74) in the rope bed (73).

12. Device according to claim 11, wherein a rope track race (77) is arranged upon an eccentrically adjustable bearing (78, 79) for prestressing the unit.

13. Device according to claim 11, wherein for prestressing the unit a rope roller (80) is supported upon a pivot lever (81) which is loaded by a spring (83) in a direction toward the rope pulley.

14. Device according to claim 1, wherein a roller guide (84) for distancing both rope strands (74', 74") is provided on the base pate (1) in the area of the lower runouts of both rope strands (74', 74").

15. Device according to claim 14, wherein the roller guide (84) is freely adjustably arranged on the base plate (1) transversely to the rope runout direction.

16. Device according to claim 15, wherein the roller guide (84) includes rope rollers (85, 86) wherein for adjusting the roller guide (84) a carriage (87) is provided for rotatably supporting the rope rollers (85, 86) of the roller guide (84), with the carriage (87) being slidably supported at guides (89) provided on the base plate (1).

17. Device according to claim 16, wherein the guides (89) are formed as rods along which the roller guide (84) is movable via retainer rollers (88).

18. Device according to claim 1, wherein guide base plate (100) are arranged on the base plate (1) or a component (67) connected therewith on the outside parallel to the tie rod (15) for slidable attachment of the device in a support frame or the like (101).

19. Device according to claim 6, wherein the screw (65) is arranged on the base plate (1) and acts upon a lever (63) which has a pivot axis (64) also arranged on the base plate (1), said tie rod being formed with a recess (60) defined by transverse flanks (61, 62), with the lever (63) engaging the recess (60) of the tie rod (15) and bearing upon the transverse flanks (61, 62) of the recess (60).

* * * * *